US005820634A

United States Patent [19]

Träubel et al.

[11] Patent Number: 5,820,634

[45] Date of Patent: Oct. 13, 1998

[54] PROCESS FOR TANNING LEATHER

[75] Inventors: Harro Träubel, Leverkusen; Fritz Novotny, Bergisch Gladbach; Helmut Reiff, Leverkusen, all of Germany

[73] Assignee: Bayer Aktiengesellschaft, Leverkusen, Germany

[21] Appl. No.: 877,381

[22] Filed: Jun. 17, 1997

[30] Foreign Application Priority Data

Jun. 21, 1996 [DE] Germany ..... 196 24 821.3

[51] Int. Cl.[6] ..... C14C 3/18; C14C 3/28

[52] U.S. Cl. ..... 8/94.26; 8/94.18; 8/94.33; 8/94.25; 8/94.27; 8/94.28; 8/94.29

[58] Field of Search ..... 8/94.18, 94.33, 8/94.25, 94.26, 94.27, 94.28, 94.29

[56] References Cited

U.S. PATENT DOCUMENTS

| | | | |
|---|---|---|---|
| 2,923,594 | 2/1960 | Lieberman et al. . | |
| 2,941,859 | 6/1960 | Fein et al. . | |
| 3,748,329 | 7/1973 | Liebsch et al. . | |
| 3,903,127 | 9/1975 | Wagner et al. . | |
| 3,976,622 | 8/1976 | Wagner et al. . | |
| 4,187,074 | 2/1980 | Träubel et al. . | |
| 4,413,997 | 11/1983 | Milligan et al. . | |
| 4,504,271 | 3/1985 | Motov et al. | 8/94.25 |
| 4,731,089 | 3/1988 | Covington | 8/94.29 |
| 4,837,359 | 6/1989 | Woynar et al. . | |
| 4,904,750 | 2/1990 | Reiners et al. . | |
| 4,919,680 | 4/1990 | Wheling et al. | 8/94.27 |
| 4,960,848 | 10/1990 | Scholl et al. . | |
| 4,994,541 | 2/1991 | Dell et al. . | |
| 5,076,958 | 12/1991 | Pedain et al. . | |
| 5,417,723 | 5/1995 | Träubel et al. . | |
| 5,618,317 | 4/1997 | Traubel et al. | 8/94.21 |
| B1 3,903,127 | 5/1985 | Wagner et al. . | |

FOREIGN PATENT DOCUMENTS

| | | |
|---|---|---|
| 0290143 | 11/1988 | European Pat. Off. . |
| 690135 | 1/1996 | European Pat. Off. . |
| 1670666 | 7/1971 | Germany . |

OTHER PUBLICATIONS

V. W. Siefken, Mono– und Polyisocyanate IV. Mitteilung über Polyurethane*, Justus Liebigs Annalen der Chemie, 52, pp. 75–136, (Date Unknown).

V. J. Kochta, et al., Alternativen zur Chromgerbung—aktueller Stand*, pp. 169–174, Das Leder, (1990), (Month Unknown).

Stather "Gerbereichemie", pp. 409, 458–459, (1967), (Month Unknown.

*Primary Examiner*—Alan Diamond

*Attorney, Agent, or Firm*—Sprung Kramer Schaefer & Briscoe

[57] ABSTRACT

Bisulphite-blocked, polyether-modified polyisocyanates are outstandingly suitable, in combination with mineral tanning agents, for the tanning of leather.

4 Claims, No Drawings

PROCESS FOR TANNING LEATHER

The invention relates to a process for the pretanning and tanning of leather using blocked polyisocyanates that contain ether groups, and mineral tanning agents.

Tanning converts animal skins, with crosslinking of the collagen, into leather. One of the most important features of leather is the heightened shrinkage temperature relative to untanned skins, i.e. the enhanced hot-water resistance, and the white appearance (not transparent or pigment-like) after drying.

The method of tanning still predominant today is chrome tanning, in which covalent bonds with a crosslinking action are formed with the carboxylic groups of the collagen using chromium(III) compounds under the influence of OH ions. By contrast, the hydrogen bonds to the amide groups of the collagen that are obtainable using polyfunctional vegetable tanning agents are much weaker, which is evident inter alia in an only moderately heightened shrinkage temperature. Aliphatic aldehides too, such as glutaraldehide, for example, which lead to crosslinking by way of the primary amino groups of the collagen have been recommended as tanning agents (U.S. Pat. No. 2,941,859). However, the aldimines produced may, in the presence of water, undergo a reversible backwards reaction to aldehide and amine.

The use of aliphatic diisocyanates such as hexamethylene diisocyanate (DE-C 72 981) has for toxicological reasons failed to establish itself.

The use of bisulphite-blocked aliphatic, cycloaliphatic or aromatic diisocyanates such as hexamethylene diisocyanate, isophorone diisocyanate and toluylene diisocyanate as tanning agents, as recommended in U.S. Pat. No. 2,923,594 and 4,413,997, does indeed lead to light-coloured and light-fast leathers, but the tanning liquors are not pH-stable.

The use of the bisulphite-blocked polyisocyanates described in EP-A 690 135, which contain polyethylene oxide groups, has applicational advantages, since the residual liquors obtained from tanning are free from heavy metal ions. The leather shrinkage temperatures which can be achieved with these products are, at more than 80° C., within the shrinkage temperatures required for the majority of leather types. If, however, it is desired to produce shoes in a highly rationalized process, then it is necessary to employ the technique known as thermosetting. In this technique, shoe uppers are pulled onto lasts and fixed (set) by means of heat (>100° C.) and steam (>80% relative humidity). This technique makes it possible to achieve a significant reduction in the production time of the shoe and to make better use of the expensive lasts. If it is desired to employ the thermosetting technique, then the materials used for it must withstand these processing conditions.

It has been found that for these and similar intended applications there is a need for leathers whose shrinkage temperatures (Ts) in the dry state are about 100° C. On the other hand, one would not like to give up the environmental advantages which are achieved with the process on which EP-A 690 135 is based. There exists, therefore, a need for a process which provides leather containing mineral tanning agent and which is associated with minimum environmental pollution.

The invention provides a process for tanning using

I. products, containing carbamoyl sulphonate groups, of the reaction of

A. organic polyisocyanate,

B. from 0.01 to 0.4 equivalents, per isocyanate group of A. of polyether alcohol with incorporated polyalkylene oxide units (the equivalents are based on the hydroxyl groups of the polyether alcohol), from 40 to 100 mol %, preferably from 50 to 100 mol %, of the polyalkylene oxide units consisting of polyethylene oxide units with a sequence length of from 5 to 70, preferably from 6 to 60, in particular from 7 to 40, C. optionally other NCO-reactive components, and D. ammonium or alkali metal bisulphites or disulphites, and subsequently II. mineral tanning agents from the series consisting of chromium(III), iron(II), iron(III), aluminium(III), titanium (IV) and zirconium(IV), without pickles, at a pH of more than 4, preferably more than 5.

The reaction products that are to be used in accordance with the invention can be obtained from the intermediates, themselves obtainable from A, B and, if used, C, with NCO contents of from 3 to 50% by weight, preferably from 5 to 45% by weight, in particular from 20 to 45% by weight (based on the intermediate) by subsequent blocking of the free isocyanate groups. The novel products then contain—calculated as sodium salt and based on solids—from 9.7 to 78% by weight, preferably from 14 to 74% by weight, in particular from 46.5 to 74% by weight, of carbamoyl sulphonate groups.

Suitable organic polyisocyanates A) are aliphatic, cycloaliphatic, araliphatic, aromatic or heterocyclic polyisocyanates, as are described, for example, by W. Siefken in Liebigs Annalen der Chemie 562, pages 75 to 136.

Preferred polyisocyanates A) are compounds of the formula $Q(NCO)_n$ having a mean molecular weight of below 800, where n is a number which is at least 2, preferably from 2 to 4, Q is an aliphatic $C_4$–$C_{12}$-hydrocarbon radical, a cycloaliphatic $C_6$–$C_{15}$-hydrocarbon radical, an araliphatic $C_7$–$C_{15}$-hydrocarbon radical or a heterocyclic $C_2$–$C_{12}$-radical with 1 to 3 heteroatoms from the series consisting of oxygen, sulphur and nitrogen, for example (i) diisocyanates such as ethylene diisocyanate, 1,4-tetramethylene diisocyanate, 1,6-hexamethylene diisocyanate, 1,12-dodecane diisocyanate, cyclobutane 1,3-diisocyanate, cyclohexane 1,3-and 1,4-diisocyanate, and any desired mixtures of these isomers, 1-isocyanato-2-isocyanatomethylcyclopentane, 1-isocyanata-3,3,5-trimethyl-5-isocyanatomethylcyclohexane, 2,4- and 2,6-hexahydrotolylene diiscoyanate, and any desired mixtures of these isomers. Hexahydro-1,3-and/or -1,4-phenylene diisocyanate, perhydro-2,4'-and/or -4,4-diphenylmethyl diisocyanate, 1,3- and 1,4-phenylene diisocyanate, 2,4-and/or -2,6-tolylene diisocyanate, and any desired mixtures of these isomers, diphenylmethane 2,4'- and/or 4,4'-diisocyanate, naphthalene 1,5-diisocyanate, polyisocyanates containing uretdione groups, such as bis(6-isocyanatohexyl) uretdione, for example, or the dimers—containing the uretdione structure—of 1-isocyanato-3,3,5-trimethyl-5-isocyanatomethylcyclohexane, and any desired mixtures of the abovementioned polyisocyanates; (ii) trifunctional and more highly polyfunctional polyisocyanates, such as the isomers of the triisocyanatotriphenylmethane series (such as triphenylmethane 4,4',4"-triisocyanate) and mixtures thereof; (iii) compounds prepared from the polyisocyanates (i) and/or (ii) by allophanatization, trimerization or biuretization and having at least three isocyanate groups per molecule. Examples of polyisocyanates prepared by trimerization are the trimer, obtainable by isocyanurate formation, of 1-isocyanato-3,3,5-trimethyl-5-isocyanatomethylcyclohexane and the isocyanurate group-containing polyisocyanates obtainable by trimerization of hexamethylene diisocyanate, optionally in a mixture with 2,4-diisocyanatotoluene. Examples of polyisocyanates prepared by biuretization are tris(isocyanatohexyl)biuret and mixtures thereof with its higher homologues, as are obtainable, for example, in accordance with DE-A 23 08 015.

Particularly preferred polyisocyanates A are those having a molecular weight of from 140 to 400 and with NCO groups attached to aliphatic or cycloaliphatic structures, such as 1,4-diisocyanatobutane, 1,6-diisocyanatohexane, 1,5-diisocyanato-2,2-dimethylpentane, 2,2,4-and 2,4,4-trimethyl-1,6-diisocyanatohexane, 1,3-and 1,4-diisocyanatohexane, 1-isocyanato-3,3,5-trimethyl-5-isocyanatomethylcyclohexane, 1-isocyanato-1-methyl-4-isocyanatomethylcyclohexane and 4,4'-diisocyanatodicyclohexylmethane, for example, and any desired mixtures of such diisocyanates. Araliphatic polyisocyanates as well, such as the xylylene diisocyanates of the formulae

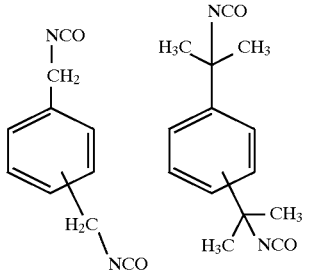

can be used.

Preference is given to the use of the above diisocyanates. However, it is also possible at the same time to use monofunctional aliphatic isocyanates, such as, for example, butyl isocyanate, hexyl isocyanate, cyclohexyl isocyanate, stearyl isocyanate or dodecyl isocyanate, and/or polyisocyanates with an average functionality of from 2.2 to 4.2.

The more highly polyfunctional isocyanates are preferably polyisocyanate mixtures, containing isocyanate groups and, if appropriate, uretdione groups and consisting of trimeric 1,6-diisocyanatohexane or 1-isocyanato-3,3,5-trimethyl-5-isocyanatomethylcyclohexane and, optionally, dimeric 1,6diisocyanatohexane or 1-isocyanato-3,3,5-trimethyl-5-isocyanatomethyl-cyclohexane and the correspondingly higher homologues, and having an NCO content of from 19 to 24% by weight, as are obtained by conventional catalytic trimerization, and with isocyanurate formation, from 1,6-diisocyanatohexane or 1-isocyanato-3,3,5-trimethyl-5-isocyanatomethylcyclohexane, preferably having a (mean) NCO functionality of from 3.2 to 4.2.

Other suitable polyisocyanates A are polyisocyanates which are prepared by modifying aliphatic or cycloaliphatic diisocyanates and have a uretdione and/or an isocyanurate, urethane and/or allophanate, biuret or oxadiazine structure, as are described by way of example in, for example, DE-A 1 670 666, 3 700 209 and 3 900 053 and in EP 336 205 and 339 396. Other examples of suitable polyisocyanates are the polyisocyanates which contain ester groups, for example the tetrakis-isocyanates or triisocyanates obtainable by reacting pentaerythritol silyl ethers or trimethylolpropane silyl ethers with isocyanato-caproyl chloride (cf. DE-A 3 743 782). Furthermore, it is also possible to use triisocyanates, such as trisisocyanatodicyclohexylmethane, for example.

The use of monofunctional isocyanates and of more than difunctional isocyanates is in both cases preferably restricted to amounts of at most 10 mol % each, based on all polyisocyanates A.

However, very particular preference is given to the above mentioned aliphatic, cycloaliphatic and araliphatic diisocyanates.

The polyether alcohols B are obtainable in a manner known per se by alkoxylating appropriate starter molecules. To prepare the polyether alcohols it is possible to employ any desired monohydric or polyhydric alcohols with molecular weights from 32 to 250 as starter molecules. As starter molecules, use is preferably made of monofunctional aliphatic $C_1$–$C_{18}$-, preferably $C_1$–$C_4$- alcohols. Particular preference is given to the use of methanol, butanol, ethylene glycol monomethyl ether or ethylene glycol monobutyl ether as starter.

Alkylene oxides which are particularly suitable for the alkoxylation reaction are ethylene oxide and propylene oxide, which can be employed in any desired sequence in the course of the alkoxylation reaction. Any other epoxides desired, such as butylene oxide, dodecene oxide or styrene oxide, for example, can also be used at the same time. Pure polyethylene oxide alcohols are particularly preferred.

Polyalkylene oxide alcohols containing ester groups can also be used at the same time. Suitable polyalkylene oxide alcohols containing ester groups are OH-terminated polyester ethers which are obtainable by reacting aliphatic $C_2$–$C_8$-dicarboxylic acids or their esters or acid chlorides with polyethers from the group consisting of polyethylene oxides, polypropylene oxides, mixtures thereof or mixed polyethers, using from 0.8 to 0.99 equivalents of carboxyl groups or derivatives thereof per OH equivalent of the polyether, and which have a mean molecular weight of below 10,000, preferably below 3,000.

The NCO-reactive components C which are used at the same time optionally comprise customary mono- to tetrafunctional building blocks used in polyurethane chemistry, such as alcohols, amines, amino alcohols and mercaptans with molecular weights of below 6,000, preferably below 2,000, such as, for example, polyesters, polyether esters and polycarbonates, aminopolyethers and the like.

Preferred components C are long-chain, optionally branched, so-called fatty alcohols or fatty amines with 12 to 30 carbon atoms, which have an "oiling" or "re-oiling" effect, and also OH containing esters of natural fatty acids such as stearic acid, oleic acid, palmitic acid, linoleic acid, linolenic acid, etc.

Very particularly preferred components C are OH-containing naturally occurring fats and oils, such as castor oil, for example.

The reaction products of components A to D, that are to be used in accordance with the invention may include up to 20% by weight of the component C.

Preferred blocking agents D are the sodium salts of sulphurous and disulphurous acid, i.e. sodium hydrogen sulphite ($NaHSO_3$) and sodium disulphite ($Na_2S_2O_5$), respectively.

It is also possible with advantage to use the other alkali metal and ammonium salts of these acids, namely potassium bisulphite, potassium disulphite, lithium bisulphite, lithium disulphite, ammonium bisulphite, ammonium disulphite and simple tetraalkylammonium salts of these acids, such as, for example, tetramethyl-ammonium bisulphite, tetraethylammonium bisulphite, etc. For blocking, the salts are preferably employed as aqueous solutions with solids contents of from 50 to 40% by weight.

The reaction products to be used in accordance with the invention can, for example, be prepared as follows:

In a first step, the polyisocyanate is reacted with the polyether alcohol B until all of the OH groups have been urethanized. The resulting NCO-terminal prepolymer is then blocked, in a second step, with alkali metal or ammonium bisulphite or disulphite, until all of the NCO groups have reacted.

The overall process is preferentially carried out without solvent as a one-pot process. The reaction (1st step) is carried out in the temperature range up to 130° C., preferably in the range between 50° C. and 120° C., particularly preferably between 80° C. and 110° C. The reaction can be monitored by titration of the NCO content or by recording the IR spectra and evaluating the carbonyl band at about 2,100 $cm^{-1}$, and is over when the isocyanate content is not more than 0.1% by weight above the value which is intended to be reached on complete conversion. In general, reaction times of less than 4 hours are sufficient.

By virtue of the use of catalysts such as dibutyltin dilaurate, tin(II) octoate or 1,4-diazabicyclo-[2.2.2]octane in amounts of from 10 to 1,000 ppm, based on the reaction components, it is possible to accelerate the reaction. The resulting NCO prepolymers, with NCO contents of from 5 to 45% by weight, are then, in a 2nd step, reacted at from 0° to 60° C., preferably at from 10° to 40° C., with aqueous solutions of alkali metal and/or ammonium sulphites and water, until all of the NCO groups have reacted. This generally requires reaction times of from 1 to 12 hours, preferably from 3 to 8 hours. The end products are visually clear aqueous solutions or, in a few individual cases, are stable, finely divided emulsions with mean particle diameters below 8000 nanometres. It can be advantageous first to react the NCO prepolymers with from 20 to 50% strength by weight aqueous solutions of the alkali metal or ammonium bisulphites or disulphites and, after from 5 to 45 minutes, to add the rest of the water, so as to end up then with a solids content of the aqueous formulations of from 10 to 50% by weight, preferably from 25 to 40% by weight.

In the first stage of a combined tanning operation of this kind, pretanning is carried out, as described in EP-A 690 135, optionally with the aid of a basifying agent with 0.1–30, preferably 0.5–10, very particularly preferably 1–7% by weight of carbamoyl sulphonate at a pH of 5–14, preferably 7.5–9.5. For basification, all known basifying agents which are customary in the tanning industry are suitable: sodium carbonate and sodium hydrogen carbonate, magnesium oxide, dolomite, tertiary amines, etc. The controlled addition of sodium hydroxide or potassium hydroxide, moreover, is generally possible (but uncommon). Particular preference is given to magnesium oxide.

In the case of pretanning with the reaction products to be used in accordance with the invention, there is no need for the low pH which is customary in the case of mineral tanning. By this means it is possible to do without the addition of salt (pickle) for example, hides are delimed to a pH of from 5 to 8, preferably around 7, the reaction product to be used in accordance with the invention is added, and basification is commenced after a running time of one hour. (In the case of calcined magnesium oxide, the addition can be commenced immediately.) Depending on the mechanical drumming effect and thickness and on the digestion (e.g. enzymatic) of the hide, pretanning and, preferably, the basification which takes place at the same can be accomplished within 4 to 6 hours. In general, however, as is conventional with chrome tanning, the process is allowed to continue overnight after the initial run of 1 hour and following the addition of the basifying agent in a further 2 steps (in each case after a running time of 1 hour), then rinsing is carried out the next morning and operation continues in the normal manner.

In general amounts of from 1 to 20% by weight, preferably from 3 to 15% by weight, based on hide weight, are used of the reaction products that are to be used in accordance with the invention. In this case, the leathers tanned with the reaction product, with shrinkage temperatures of above 70° C., preferably above 75° C., serve as the initial stage (analogous to wet blue) for final tanning.

This final tanning can be carried out at a pH of more than 4, preferably more than 5, free from pickle and salt and with a minimum amount of mineral tanning agent. Suitable mineral tanning agents are salts of aluminium, chromium, iron, titanium and zirconium. The maximum achievable shrinkage temperatures in the case of aluminium (Ts=70°–80° C.), iron (Ts=70°–80° C.), titanium (Ts=75°–85° C.) or zirconium (Ts=70°–80° C.) according to J. Kochta et al., Das Leder, Aug. 1990, are in some case heightened as a result of this combined tanning. With the process according to the invention, 100° C. is attained and—depending on the amount used and the process regime (pH, temperature, etc.)—significantly exceeded.

A particularly preferred mode of operation consists in the use of tanning chromium compounds which are stable at high pH. Such pH-stable chromium compounds are described, for example, in EP-A 304 677; use is made therein of a reaction product prepared in aqueous solution of basic chromium(III) sulphate and, per mole of chromium oxide of the basic chromium(III) sulphate, from 0.2 to 0.8 mol of aliphatic $C_4$–$C_6$-dicarboxylic acid, with subsequent establishment of the theoretical basicity to from 0 to 50%, the addition of the reaction product to the pickling liquor taking place as an aqueous solution with a chromium oxide content of at least 5% by weight or in pulverized form in an amount of from 0.9 to 1.5% by weight of chromium oxide (based on hide weight), the liquor volume being less than 100% by weight (based on hide weight), the final pH being over 4.0 and the final temperature being over 40° C. Whether a chromium(III) compound has a tanning action or not is determined by means of its basicity (see F. Stather, Gerbereichemie and Gerbereitechnologie [Chemistry and technology of tanning], Leipzig, 1967, pp. 409, 458–459).

In Example 1 of EP-A 304 677 a product is described which has 0.2 mol of glutaric acid per mole of $Cr_2O_3$, with a basicity of 30. This product can be added without salt and pickle in a short liquor with a pH of up to 9, preferably 5–8, to the material which is to be tanned, without any spontaneous precipitation. Tanning proceeds without the need for basification. With amounts of only 1.25% by weight of $Cr_2O_3$ (based on shaved weight), shrinkage temperatures of about 100° C. are obtained. A particular advantage of a combined procedure of this kind is the high exhaustion of chromium(III) salt from the residual liquor from tanning: with a liquor length of, for example, 50% by weight at 40° C., a leather shaved to about 1 mm is fully tanned after 2–3 hours (with a $Cr_2O_3$ content in the leather of about 3% by weight), and in the residual liquor from this tanning a $Cr_2O_3$ content of 0.4 a per litre is found with a final pH (the pH falls as a result of the added tanning agent) of 4.1.

Purely on a calculation basis, the following, picture results relative, for example, to Example 12 of EP-A 304 677, an example which constitutes a process optimized terms of exhaustion:

Comparison: Material balance, conventional versus carbamoyl sulphonate

| | high-exhaust tanning as per EP-A 304 677 | carbamoyl sulphonate as per EP-A 690 135 |
|---|---|---|
| salt weight | 430 kg | 430 kg |
| split weight (hide) | 142 kg | |
| shaved weight | | 67 kg |

-continued

| | | |
|---|---|---|
| liquor | 72 kg | 34 kg |
| NaCl | 7.2 kg | 0 |
| sulphuric acid | 1.5 kg | 0 |
| $Cr_2O_3$/l residual liquor | 0.3 g | 0.4 g |
| Cr in overall liquor | 14.4 g | 9.2 g |

| | Comparison/invention | | |
|---|---|---|---|
| | Raw hide | Example 12 of EP-A 304 677 | Example carbamoyl sulphonate/chromium |
| amount used, salted | 1000 kg | 430 kg | 430 kg |
| Total waste water | 18000 kg | 7740 kg | 7740 kg |
| Cr-containing shavings | 145 kg | 65 kg | 0 |
| Cr-free shavings | 0 | 0 | 23 kg |
| Cr in total waste water | 0 | 2 ppm | 1.2 ppm |

In Example A 66 of EP-A 690 135 a tanning operation is described in which, following pretanning with carbamoyl sulphonate, formic acid and then a commercially available self-basifying chrome tanning agent was added. This type of tanning already provides leathers with a high shrinkage temperature and residual liquors which show sufficiently good chrome exhaustion. If, however, a formate- or dicarboxylate-stabilized chrome tanning agent is employed in accordance with EP-A 304 677, there is a further reduction in the content of chromium 3+ions in the residual liquor.

Insofar, therefore, as use is made of a stabilized self-basifying chrome tanning agent, it is possible after pretanning, optionally after shaving, to carry out tanning without a reduction in pH and without pickle at a pH of at least 4 and then to carry out retanning in the customary manner.

Retanning can, as usual, be carried out with synthetic organic polymers (incl. resin tanning agents) or with vegetable tanning agents.

The mean molecular weights specified in this application are number-average molecular weights.

The percentages in the examples which follow are based in each case on the weight and on hide/leather.

EXAMPLES

Assistants used

®BAYCHROM A self-basifying chrome tanning agent from Bayer AG containing 21% chromium oxide ®BAYCANOL TF-2N dyeing assistant based on aromatic sulphonic acid, from Bayer AG ®BAYGENAL Brown CGG Acid Brown 83 from Bayer AG ®BAYMOL FD fl. 80% strength aqueous solution of a nonionic emulsifier, from Bayer AG ®BLANCOROL ZB 33 0% basic zirconium sulphate with 33% zirconium oxide, from Bayer AG ®BLANCOROL ZBE 50% basic zirconium sulphate with 31% zirconium oxide, from Bayer AG ®TANIGAN BN organic-synthetic replacement tanning agent from Bayer AG based on dihydroxydiphenyl sulphone and naphthalenesulphonic acid; acid number 85

®TANIGAN LF synthetic replacement and whitening tanning agent from Bayer AG

®TANIGAN PAK-N neutralizing tanning agent based on aromatic sulphonic acid, from Bayer AG ®TANIGAN OS replacement tanning agent with a composition similar to that of TANIGAN BN and an acid number of 32, from Bayer AG ®RETINGAN R7 anionic resin tanning agent from Bayer AG, with a selective filling action, based on dicyandiamide Quebracho, mimosa, chestnut: commercially available vegetable tanning agents ®CUTAPOL TIS-MF sulphited fish oil, 65% a.i . from Dr. Th. Bohme ®CORIPOL MK mixture of sulphited natural oils and synthetic sulpho esters, from Stockhausen & Cie.

®LUTAN BN basic aluminium chloride from BASF AG

®TETRAPOL SAF softening stabilizer based on fatty alcohols, from Stockhausen & Cie.

®POLYZIM 202 proteolytic pancreas-based mordant from Diamalt

Magnesium oxide Magnesia 322 from Magnesia GmbH, Lüneburg

Example 1

Customarily lime-soaked hide is split to 2 mm. The hide is then placed in a customary tanning drum and washed once with 200% (percentages, hereinbelow, are based on split weight) of water at 35° C. for 15 minutes. The liquor is then drained off. In the subsequent deliming operation, 30% of water at 35° C., 2% of ammonium sulphate and 0.2% of sodium meta-bisulphite are added and the drum is agitated for 10 minutes. Subsequently, 0.2% of formic acid (diluted 1:10) and 0.2% of BAYMOL FD liquid are added, and the batch is left to run for 20 minutes. Using 0.5% of Polyzim 202, mordanting is carried out in the same liquor for 30 minutes. The resulting pH is 7.9 (cut in the hide with phenolphthalein colourless). The liquor is then drained off.

The hide is washed twice with 150% of water (at room temperature) and the liquor is drained off.

At the tanning stage which now begins, 30% of water at 30° C. is introduced, and 0.35% of magnesium oxide (Magnesia 322) and, after 60 minutes, 7.5% (based on active ingredient) of a product prepared in accordance with Example 1 of EP-A 690 135 are added. After a running time of 6 hours, a pH of 7.1 is established, a further 0.35% of magnesium oxide (Magnesia 322) is added and running is continued overnight, (final pH 6.8). The next morning, the resulting leather has a shrinkage temperature of 78° C.

The liquor is drained and the leathers are rinsed at room temperature for 10 minutes and then are sammed and shaved to a thickness of 1 mm.

The shaved leathers are placed in a drum and washed for 10 minutes with 200% (based on shaved weight) of water (at room temperature). The liquor is drained off.

The subsequent mineral tanning is initiated by 50% of water at 35° C. (the pH which has become established is 6.8) and by 5% of a product prepared in accordance with Example 1 of EP-A 304 677. After agitation for 150 minutes a pH of 4.1 becomes established.

The liquor is drained off; the leathers have a Ts of 100° C. After a washing operation with 300% of water at 40° C. (10 minutes) the liquor is drained off. In the neutralization stage, which now ensues, 200% of water (40° C.), 3% of TANIGAN PAK-N for 1 hour (pH 4.7), and then 4% of CUTAPOL TIS-MF (diluted 1:4) for 30 minutes are caused to act on the leather. The assistants are then drained off and the leather is washed for 10 minutes with 200% of water (35° C.). Using 150% of water (40° C.), retanning is begun; 3% of TANIGAN BN and 2% of TANIGAN LF for 20 minutes, then a solution of 3% BAYGENAL Brown CGG and 2% of BAYKANOL TF-2N (1:20 in water at 60° C.) are added. After 60 minutes, 100% of water (70° C.) are added, after a further 10 minutes 2% of formic acid (diluted 1:5) are added, and running is continued for 30 minutes (pH3.4). After the liquor has been drained off, fatliquoring is carried out in 200% of water (50° C.) using a mixture of 8% of CORIPOL MK, 6% of CUTAPOL TIS-MF and 1% of TETRAPOL SAF (diluted 1:4 with water at 60° C.) for 90 minutes. This is followed by 1.5% of formic acid (diluted 1:5) for 45 minutes (pH 3.1); the liquor becomes clear. After the liquor has been drained off, washing is carried out twice with 200% of water at room temperature, for 10 minutes each time. The leathers are placed on a trestle, stretched while wet, acclimatized, staked, milled, stretched and assessed.

Example 2

In accordance with Example A 1 of EP-A 690 135, 12 pieces of 100 g of cattle hide in 40% of liquor containing 0.35% of magnesium oxide were left to run initially in a small experimental drum from Dose (pH 7.4); then 7.5% (active ingredient) of a product in accordance with Example 1 of EP-A 690 135 were added, followed after 3 hours by a further 0.35% of magnesium oxide (pH 6.6), after which running was continued overnight. The resulting leather had a Ts of 77° C. 5 of these leathers were adjusted in 100% of liquor, containing 0.05% of formic acid in 0.08% of sulphuric acid, to a pH of 3, a further 3 were adjusted with 0.08% of sulphuric acid to a pH of 4, and one each was adjusted with 0.03% of formic acid to a pH of 5, one at 6.6 (left as it is) and one adjusted with 0.04% of 42% strength aqueous sodium hydroxide solution to 8.2. All of these leathers were then subjected to mineral retanning.

| Leather | Initial pH | Tanned with | % | Final pH | Additives | % | Ts °C. |
|---|---|---|---|---|---|---|---|
| 1 | 6.6 | — | — | 6.6 | — | — | 77 |
| 2 | 5 | Chromium of Example 1 | 5 | 3.7 | — | — | 100 |
| 3 | 6.5 | Chromium of Example 1 | 5 | 3.9 | — | — | 100 |
| 4 | 8.2 | Chromium of Example 1 | 6 | 3.7 | — | — | 100 |
| 5 | 3 | LUTAN BN | 6 | 3 | — | — | 80 |
| 6 | 4 | " | 6 | 4.1 | — | — | 79 |
| 7 | 3 | BLANCOROL ZB 33 | 4 | 3 | — | — | 74 |
| 8 | 4 | BLANCOROL ZB 33 | 4 | 4 | — | — | 75 |
| 9 | 3 | BLANCOROL ZBE | 4 | 3 | — | — | 74 |
| 10 | 3 | Ammonium titanyl sulphate (22% $TiO_2$) | 6 | 4.2 | Citric acid | 1 | 82 |

Examples 3 to 6

The Example given in EP-A 690 135 under A 66 was reworked (Examples 3 to 5) are compared with the novel process (Example 6). The leathers obtained were examined with respect to the shrinkage temperature, and the chromium contents of the leathers and of the residual liquors were determined.

Description of Experiments

| | Comparison Example 3 | Comparison Example 4 | Comparison Example 5 | Example 6 |
|---|---|---|---|---|
| Hide weight | 190 g | 180 g | 150 g | 150 g |
| Water (30° C.) | 50% | 50% | 50% | 50% |
| Carbamoyl sulphonate according to Example 7 of EP-A 690 135 | 30% | 10% | 30% | 30% |
| MgO after 3 h | 0.5% | 0.3% | 0.5% | 0.5% |
| MgO Running time 12 h | 0.5% | 0.2% | 0.5% | 0.5% |
| Final pH | 7.2 | 9.5 | 6.7 | 6.9 |
| Shrinkage temperature (°C.) | 84 | 85 | 80 | 80 |
| Rinse, shave to 1 mm then tan | | | | |
| Shaved weight (g) | 67 | 75 | 72 | 78 |
| Water 40° C. | 100% | 100% | 100% | 100% |
| Formic acid | 0.25% | 0.25% | | |
| Sulphuric acid | 1% | 1% | | |
| after 2 h; pH | 3.6 | 3.5 | 6.7 | 6.9 |
| Drain liquor | | | | |
| Water 25° C. | 100% | 100% | 100% | 100% |
| BAYCHROM A containing 21.2% $Cr_2O_3$ | 6% | 6% | #6% | — |
| Chrome tanning agent according to Example 1 of EP 304 677 containing 24.8% $Cr_2O_3$ from 25° C. to 40° C. over 6 h then 2 h at 40° C. | — | — | — | 5% |
| Final pH | 6.3 | 6.2 | 6.7 | 4.3 |
| Shrinkage temp. (°C.) | 93 | 90 | 85 | 100 |
| Content of $Cr_2O_3$ in the leather (%) | 3.2 | 3.2 | 3.3 | 3.3 |
| Content of $Cr_2O_3$ in residual liquor | 0.1 g/l | 0.1 g/l | 0.5 g/l | 0.3 g/l |

: in this case, the chrome tanning agent precipitated, but redissolved in the liquor after some time; distribution of chromium in the leather unequal, resulting in inadequate shrinkage temperature and slight marks on the leather.

In order to obtain leathers of high shrinkage temperature using the tanning method of EP-A 690 135, one should—in order to prevent precipitation—carry out pickling. If, however, it is desired to avoid the pickling operation, then tanning agents similar to those of EP-A 304 677 are advisable, if value is placed at the same time on high exhaustion from the residual liquors from the tanning operation.

We claim:

1. Process for tanning of leather which comprises applying to the leather

I. A product containing carbamoyl sulphonate groups, formed by the reaction of

A. an organic polyisocyanate,

B. from 0.01 to 0.4 equivalents, per isocyanate group of A of polyether alcohol with incorporated polyalkylene oxide units, the equivalents being based on the hydroxyl groups of the polyether alcohol, from 40 to 100 mol % of the polyalkylene oxide units consisting of polyethylene oxide units with a sequence length of from 5 to 70, C. optionally other NCO-reactive components, and D. ammonium or alkali metal bisulphites or disulphites, and subsequently II. A mineral tanning agent from the group consisting of $C_4$–$C_6$-Dicarboxylate complexes of chromium(III); iron(II), iron(III), aluminum(III), titanium(IV) and zirconium(IV), without pickles, at a pH of more than 4.

2. Process according to claim 1, wherein the mineral tanning agent is titanyl sulphate and/or a citrate complex titanyl sulphate.

3. Process according to claim 1, wherein the mineral tanning agent is basic, tanning-active aluminium salt.

4. Process according to claim 1, wherein the tanning agent is a tanning-active zirconium compound.

* * * * *